US007744427B2

(12) United States Patent
Zhang et al.

(10) Patent No.: US 7,744,427 B2
(45) Date of Patent: Jun. 29, 2010

(54) ELECTRICAL CONNECTORS FOR STORAGE DEVICE

(75) Inventors: George (Huanyi) Zhang, Irvine, CA (US); Bin Pan, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 56 days.

(21) Appl. No.: 12/288,143

(22) Filed: Oct. 16, 2008

(65) Prior Publication Data

US 2010/0099307 A1 Apr. 22, 2010

(51) Int. Cl.
*H01R 24/00* (2006.01)

(52) U.S. Cl. ..... 439/660; 439/638

(58) Field of Classification Search ..... 439/660, 439/638, 540.1

See application file for complete search history.

(56) References Cited

U.S. PATENT DOCUMENTS

| | | | | |
|---|---|---|---|---|
| 2004/0185721 | A1* | 9/2004 | Moffett et al. | 439/660 |
| 2007/0212944 | A1* | 9/2007 | Sun | 439/660 |
| 2008/0188136 | A1* | 8/2008 | Su et al. | 439/660 |
| 2009/0042451 | A1* | 2/2009 | He et al. | 439/660 |

* cited by examiner

*Primary Examiner*—Hien Vu
(74) *Attorney, Agent, or Firm*—Wei Te Chung; Andrew C. Cheng; Ming Chieh Chang

(57) ABSTRACT

An electrical connector (100) provides an interface for storage device. The electrical connector (100) includes an insulated housing (10) and a number of electrical contacts (S1-S7, P1-P9) disposed in the insulated housing (10). The insulated housing (10) defines a slot (16) for receiving a integral tongue portion (26) of a mating electrical connector (200). The number of electrical contacts (S1-S7, P1-P9) are lined along an inner side face (167) of the slot (16) for mating with the mating electrical connector (200). The first inner side face (167) of said slot (16) defines two grooves (166, 168) for polarizing the mating electrical connector (200) and the internal micro Serial ATA plug connector from other Serial ATA cables.

8 Claims, 5 Drawing Sheets

ELECTRICAL CONNECTORS FOR STORAGE DEVICE

BACKGROUND OF THE INVENTION

1. Field of the Invention

The present invention generally relates to an electrical connector, and more particularly to an electrical connector providing an interface for a storage device.

2. Description of Related Art

The Serial ATA International Organization published a proposed Serial ATA draft specification of revision 0.70 on 21 Sep. 2006. The Serial ATA draft specification disclosed an internal micro Serial ATA plug connector (hereinafter the Micro SATA plug) and an internal micro Serial ATA backplane connector (hereinafter the Micro SATA backplane) for mating with the Micro SATA plug in Pages 101-109.

The micro SATA plug has a signal segment and a power segment sharing a common base. The signal segment has a tongue portion extending from the common base for mating into the micro SATA backplane and seven signal contacts disposed in one side face of the tongue portion for delivering signals. The power segment has a tongue portion extending from the common base for mating into the micro SATA backplane and nine power contacts disposed in one side face of the tongue portion for delivering powers. The tongue portions of the signal segment and the power segment are coplanar and the contacts of the signal segment and the power segment are disposed on the same side of the tongue portions.

The micro SATA backplane has a signal segment and a power segment for mating with the signal segment and the power segment of the micro SATA plug. The signal segment and the power segment share a common insulated housing. The signal segment defines a slot in the housing for receiving the tongue portion of the signal segment of the micro SATA plug. The signal segment has seven signal contacts disposed in one inner side face of the slot for delivering signals. The power segment defines another slot in the housing besides the slot of the power segment for receiving the tongue portion of the power segment of the micro SATA plug. The power segment has nine power contacts (two of them are optional MFG pins) disposed in one inner side face of the slot for delivering powers.

However, the market demands new interfaces to increase the transfer speed of the micro SATA specification and compatible with the micro SATA plug and incompatible with micro SATA backplane.

SUMMARY OF THE INVENTION

Accordingly, an object of the present invention is to provide electrical connectors with higher transfer speed comparing the internal micro Serial ATA specification.

Another object of the present invention is to provide electrical connectors having new interfaces compatible with the micro SATA plug and incompatible with the micro SATA backplane.

In order to achieve the object set forth, an electrical connector in accordance with the present invention comprises an insulated housing and a plurality of electrical contacts assembled to the insulated housing. The insulated housing defines a longitudinal slot in a front face, the slot having a first and a second inner side faces facing to each other, and the first and second inner side faces extending in a first direction perpendicular to the front face. The plurality of electrical contacts are lined along the first side face, each of said electrical contacts extending along the first direction for mating with a mating electrical connector. The first inner side face of said slot defines two grooves extending along the first direction from the front face for polarization.

In order to achieve the object set forth, another electrical connector in accordance with the present invention comprises an insulated housing and a plurality of electrical contacts assembled to the insulated housing. The insulated housing has a base portion and an integral tongue portion extending from a front face of the base portion along a first direction, the integral tongue portion defining a first side face parallel to the first direction and a second side face opposite to the first side face. The plurality of electrical contacts are lined along the first side face, each of said electrical contacts extending along the first direction for mating with a mating electrical connector. The integral tongue portion forms two ribs extending along the first direction from the front face of the base portion, said two ribs being disposed on the first side face of the integral tongue portion for polarization.

In order to achieve the object set forth, an electrical connector assembly in accordance with the present invention comprises a first electrical connector and a second electrical connector mating into the first electrical connector. The first electrical connector further comprises a first insulated housing defining a front face and a plurality of electrical contacts disposed in the first insulated housing. The first insulated housing defines a longitudinal slot in the front face, the slot having a first and a second inner side faces facing to each other, and the first and second inner side faces extending in a first direction perpendicular to the front face. The plurality of electrical contacts are lined along the first inner side face, each of said electrical contacts extending along the first direction. The first inner side face of said slot defines two grooves extending along the first direction from the front face, said two grooves dividing the plurality of contacts into three groups. The second electrical connector further comprises a second insulated housing and a plurality of electrical contacts assembled to the second insulated housing. The second insulated housing has a base portion and a tongue portion extending from a front face of the base portion along a first direction for mating into the slot of the first insulated housing. The tongue portion defines a first side face parallel to the first direction and a second side face opposite to the first side face. The plurality of electrical contacts are disposed along the first side face of the tongue portion and used for mating with the electrical contacts of the first electrical connector. The integral tongue portion has two ribs extending along the first direction from the front face of the base portion for respectively mating into the two grooves the first insulated housing.

In order to achieve the object set forth, an electrical connector assembly in accordance with the present invention comprises an insulated housing, a first plurality of electrical contacts and a second plurality of electrical contacts assembled to the insulated housing. The insulated housing and the first plurality of electrical contacts form a power segment and a signal segment compatible with an internal micro Serial ATA connector. The second plurality of electrical contacts form a secondary port for mating with a mating connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
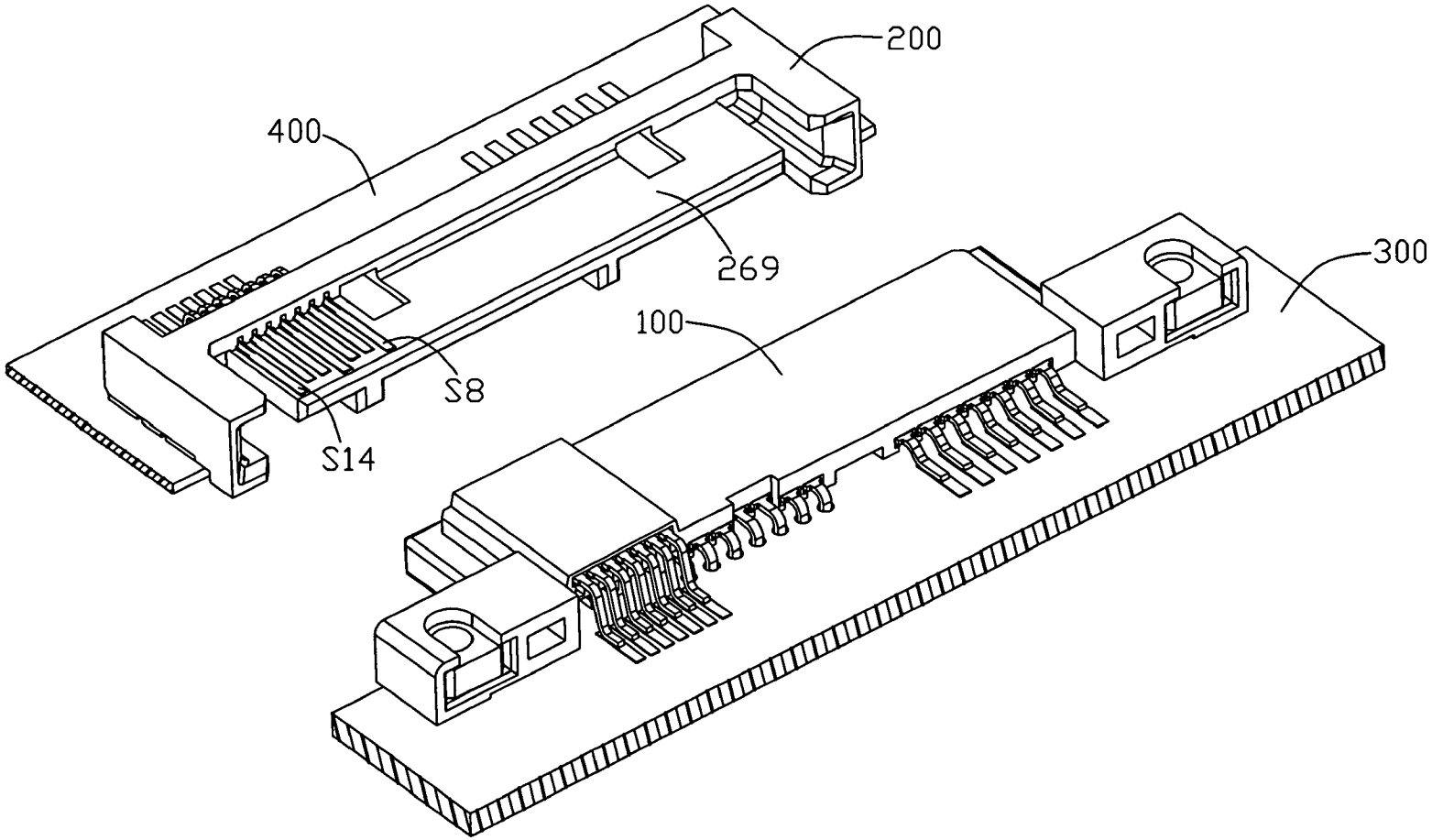
FIG. 1 is a perspective view of an electrical assembly in accordance with the present invention, the electrical assembly including a first electrical connector and a second mating electrical connector.

Referring to FIG. 1, an electrical connector assembly including a first electrical connector 100 mounted on a first circuit board 300 and a second electrical connector 200 mounted on a second circuit board 400 is shown. The electrical connectors 100, 200 are used for providing interfaces for a storage device.

Figure 3:
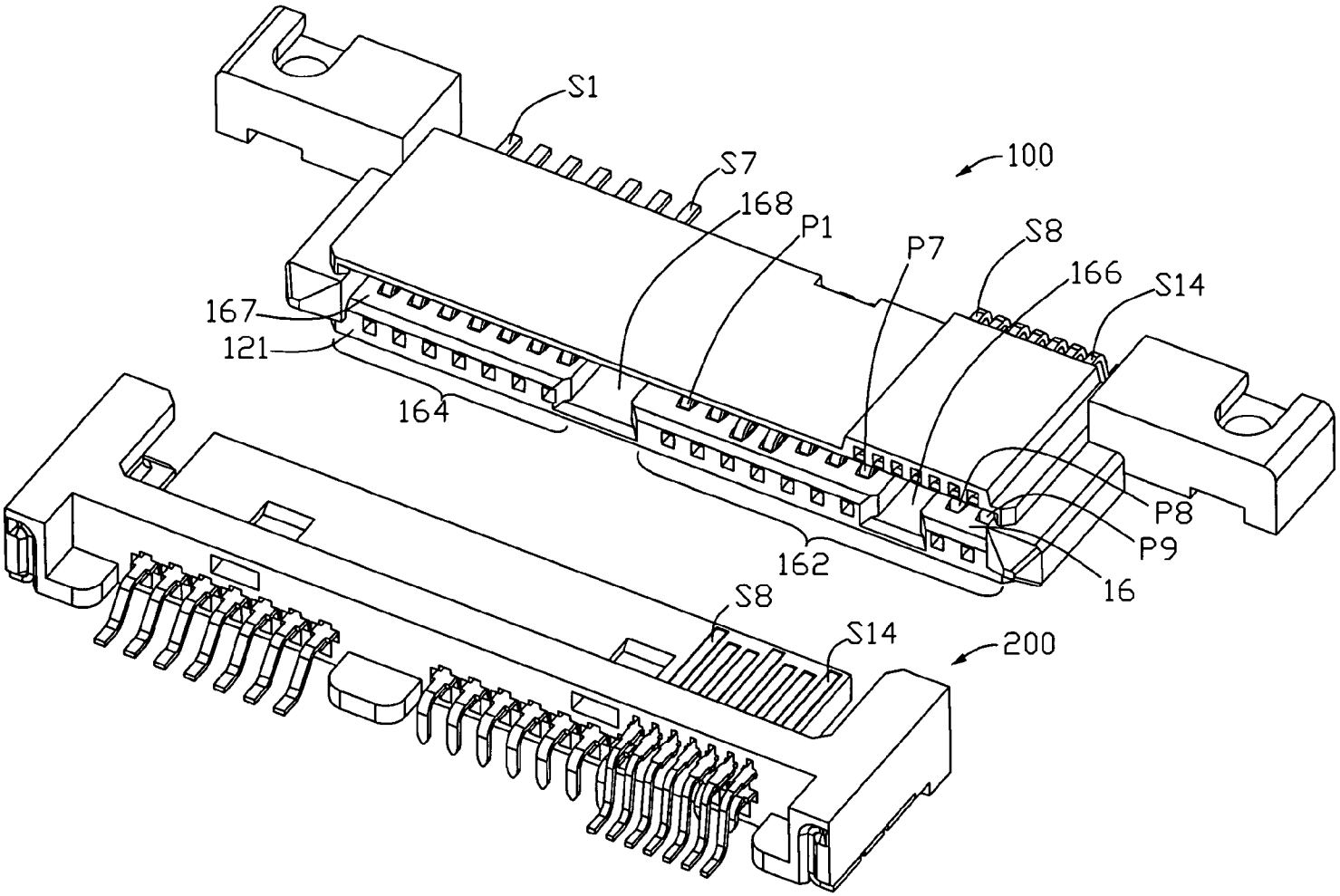
FIGS. 3-4 are views similar to FIG. 2, but viewed from different aspects.
Figure 4:
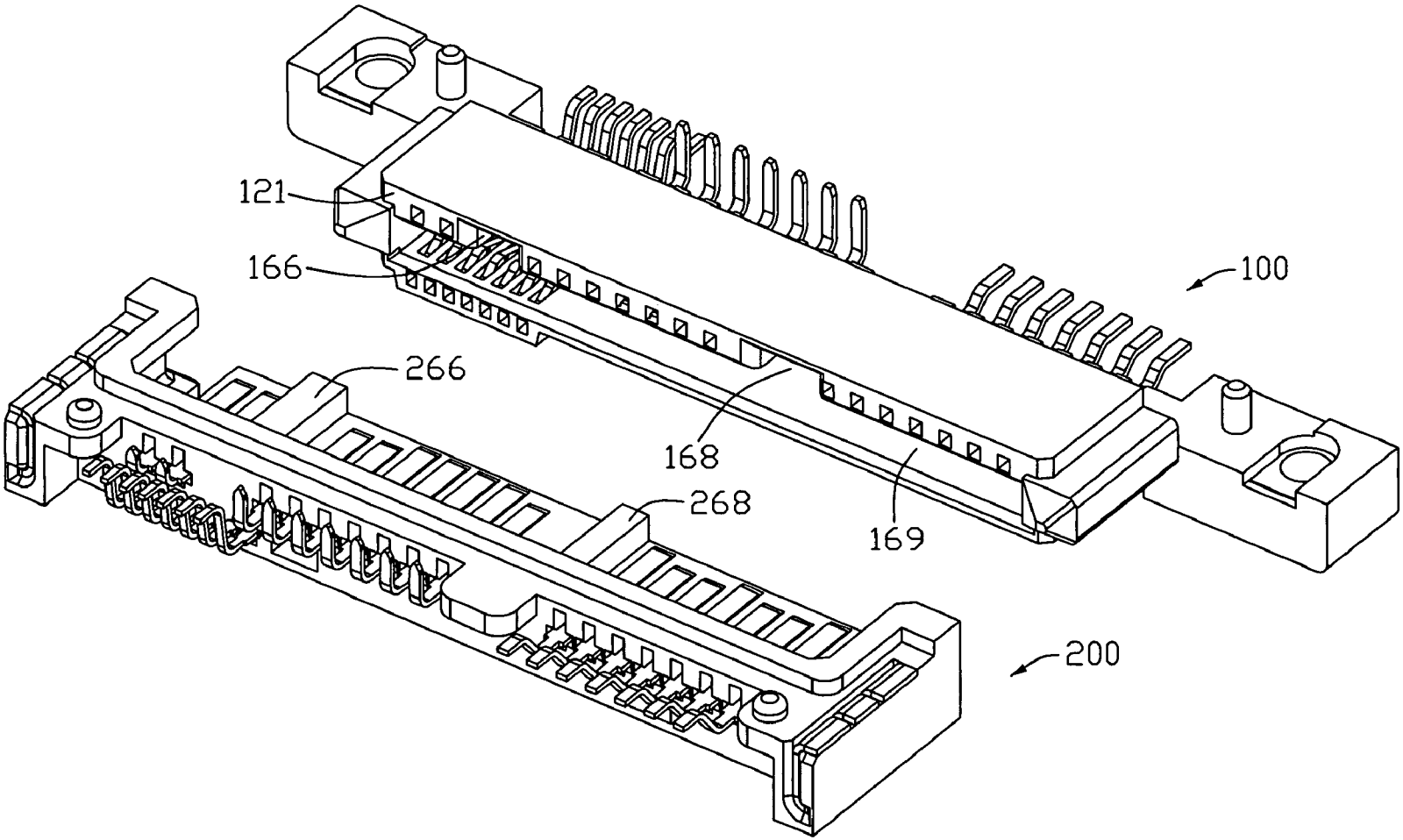
Figure 6:
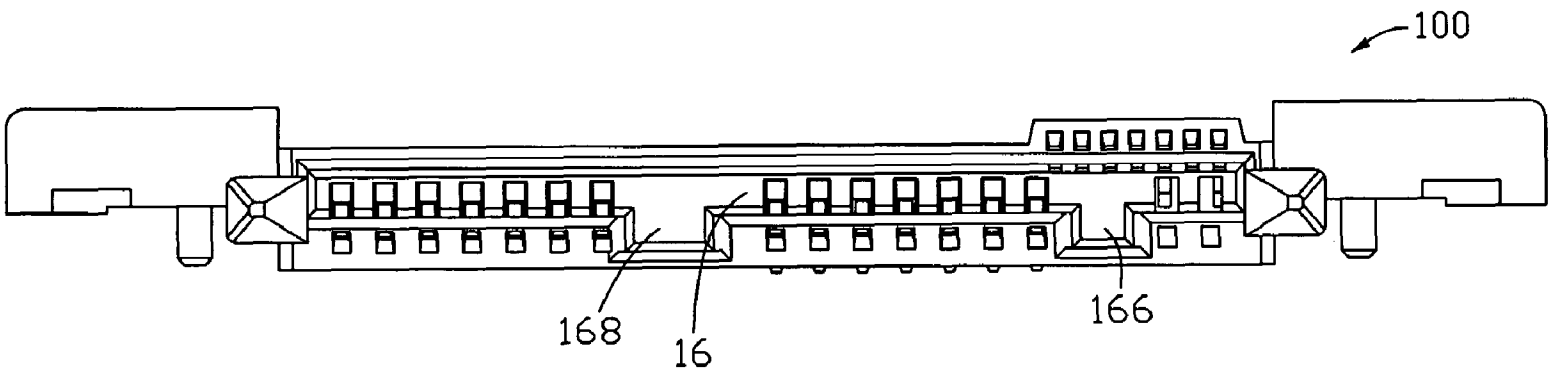
FIG. 6 is a front view of the first electrical connector.

Referring to FIGS. 3, 4 and 6, the first electrical connector 100 comprises a first insulated housing 10 defining a front face 121 and a first plurality of electrical contacts S1-S7, P1-P9 assembled to the first insulated housing 10. The first insulated housing 10 defines a longitudinal slot 16 in the front face 121, the slot 16 having a first and a second inner side faces 167, 169 facing to each other, and the first and second inner side faces 167, 169 extending in a first direction perpendicular to the front face 121. The plurality of electrical contacts S1-S7, P1-P9 are lined along the first side face 167, each of said electrical contacts S1-S7, P1-P9 extending along the first direction for mating with the second electrical connector 200. The first inner side face 167 of said slot 16 further defines two grooves 166, 168 extending along the first direction from the front face 121, said two grooves 166, 168 dividing the plurality of contacts S1-S7, P1-P9 into three groups. The three groups of contacts are respectively named in turn the first, the second and the third groups.

The slot and the grooves are shaped compatible with an internal micro Serial ATA plug connector and the grooves prevents insertion of other Serial ATA cables. Being compatible with the internal micro Serial ATA plug connector, the first group of contacts composes of two optional contacts P8, P9 used for delivering power; the second group of contacts composes of seven contacts P1-P7 used for delivering power; the third group of contacts composes of seven contacts S1-S7 used for delivering signal, wherein the optional contacts P8, P9 are not used in some times and are not presented in the figures.

Referring to FIGS. 3, 4 and 6, the electrical connector further comprises a second plurality of electrical contacts S8-S14 assembled to the first insulated housing 10 and lined along the second side face 164, each of said second plurality of electrical contacts S8-S14 extending along the first direction for mating with the second electrical connector 200. The second plurality of electrical contacts composes of seven contacts S8-S14 aligned to the first group of the contacts P8, P9 and the neighboring groove 166 in a second direction perpendicular to the second side face 164. The second plurality of contacts S8-S14 are lined in turn the first to seventh contacts, wherein the first, the forth and the seventh contacts P8, P11, P14 are used for grounding and the second, the third, the fifth and the sixth P9, P10, P12, P13 are used for delivering signal.

Figure 2:
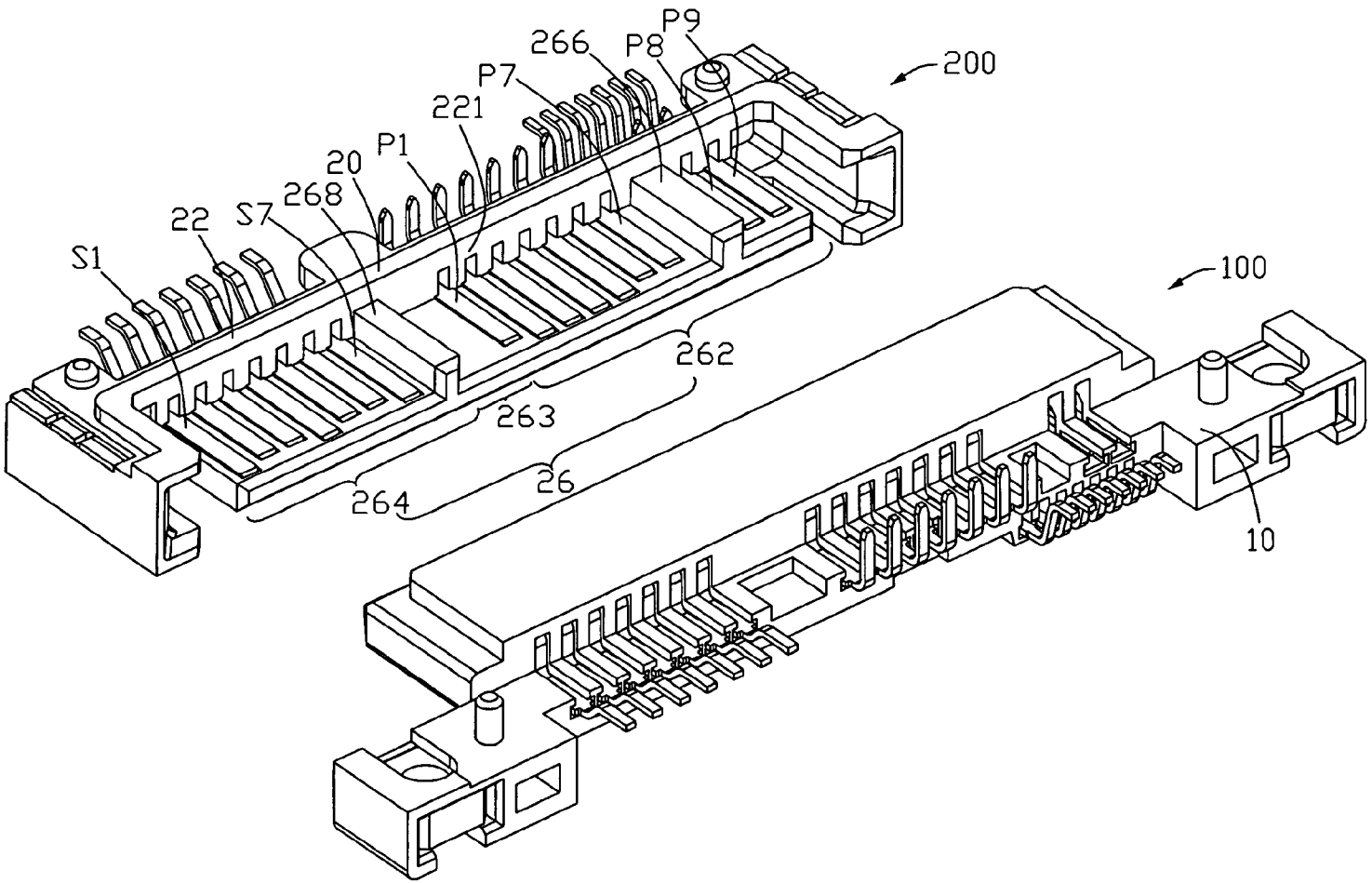
FIG. 2 is a view similar to FIG. 1, except that the circuit boards on which the first and the second electrical connectors are respectively mounted have been removed and the connectors are viewed from a different aspect.
Figure 5:
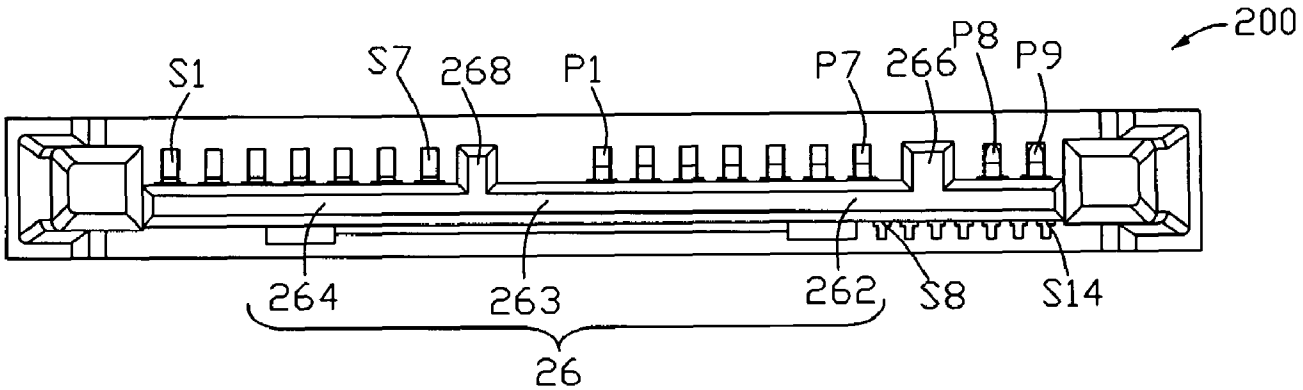
FIG. 5 is a front view of the second electrical connector.

Referring to FIGS. 1, 2 and 5, a second electrical connector 200 in accordance with the present invention is shown. The second electrical connector 200 comprises a second insulated housing 20 and a first plurality of electrical contacts S1-S7, P1-P9 assembled to the second insulated housing 20. The insulated housing 20 has a base portion 22 defining a front face 221 and an integral tongue portion 26 extending from the front face 221 along a first direction, the integral tongue portion 26 defining a first side face 267 parallel to the first direction and a second side face 269 opposite to the first side face 267. The first plurality of electrical contacts S1-S7, P1-P9 are lined along the first side face 267, each of said electrical contacts S1-S7, P1-P9 extending along the first direction for respectively contacting the contacts S1-S7, P1-P9 of the first electrical connector 100. The integral tongue portion 26 forms two ribs 266, 268 on the first side face 267 of the integral tongue portion 26. The two ribs 266, 268 extend along the first direction from the front face 221 of the base portion 22 and divide the plurality of contacts S1-S7, P1-P9 into three groups. The three groups of contacts S1-S7, P1-P9 are respectively named in turn the first, the second and the third groups.

The integral tongue portion 26 has a middle segment 263 between a power segment 262 having two groups of said contacts P1-P9 and a signal segment 264 having one group of said contacts S1-S7. The power segment 262 and the signal segment 264 could be compatible with an internal micro Serial ATA backplane connector except that the middle segment 263 prevents insertion of the electrical connector 200 into the internal micro Serial ATA backplane connector. The first group of contacts composes of two optional contacts P8, P9 used for delivering power, wherein the optional contacts P8, P9 are not used in some times. The second group of contacts composes of seven contacts P1-P7 used for delivering power. The third group of contacts composes of seven contacts S1-S7 being used for delivering signal.

The electrical connector further comprises a second plurality of electrical contacts which best shown in FIGS. 1, 2 and 5. The second plurality of electrical connector S8-S14 are lined along the second side face 269, each of the second plurality of electrical contacts S8-S14 extending along the first direction for mating with the first electrical connector 100. The second plurality of electrical contacts compose of seven contacts S8-S14 aligned to the first group of contacts P8, P9 and the neighboring rib 266 in a second direction perpendicular to the second side face 269. The second plurality of contacts S8-S14 are lined in turn the first to seventh contacts, wherein the first, the forth and the seventh contacts S8, S11, S14 are used for grounding and the second, the third, the fifth and the sixth S9, S10, S12, S13 are used for delivering signal.

So it could be drawn from the above description that the first electrical connector 100 is compatible with the second electrical connector 200 and the internal micro Serial ATA plug connector, while the second electrical connector 200 is incompatible with the internal micro Serial ATA backplane connector. In addition, the first and the second electrical connectors add a secondary port at the internal micro Serial ATA connectors to increase the transfer speed. The ground contacts and the signal contacts of the second plurality of the contacts S8-S14 is specially arranged for higher transfer speed.

It can be noted that the key concept of the instant invention is to provide a new interface based upon the old interface wherein the old interface defines the two separate mating tongues, of a male/plug connector, each having a corresponding key, respectively received in the two separate receiving cavities, of a female/host connector, each having a corresponding keyway. While the new interface adds a bridge to link these two separate mating tongues in the male connector and also removes the partition between the two separate receiving cavities. Under this arrangement, the new interface host connector can receive both the older interface plug connector and the new interface plug connector, while the older interface host connector can only receive the old interface plug connector but not the new interface plug connector. The concept of this one way reception is like the new version computer system should be able to read both old and new version memory devices while the old version computer system can not read the new version memory device but the old version one. The invention is to use the mechanical way, i.e., adding the bridge and removing the partition, to achieve this anti-mismating function.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector providing an interface for storage device, comprising:

an insulated housing defining a longitudinal slot in a front face, the slot having a first and a second inner side faces facing to each other, and the first and second inner side faces extending in a first direction perpendicular to the front face;

a plurality of electrical contacts disposed in the insulated housing and lined along the first inner side face, each of said electrical contacts extending along the first direction for mating with a mating electrical connector;

wherein the first inner side face of said slot defining two grooves extending along the first direction from the front face;

wherein the slot and the grooves are shaped compatible with an internal micro Serial ATA plug connector and the grooves prevents insertion of other Serial ATA cables;

wherein said two grooves divides the plurality of contacts into three groups in turn the first, the second and the third groups, the first group of contacts composing of two optional contacts used for delivering power, the second group of contacts composing of seven contacts used for delivering power, the third group of contacts composing of seven contacts being used for delivering signal;

wherein the electrical connector further comprises a second plurality of electrical contacts assembled to the insulated housing and lined along the second side face, each of said second plurality of electrical contacts extending along the first direction for mating with said mating electrical connector; and wherein the second plurality of electrical contacts composes of seven contacts and are aligned to the first group of contacts and the neighboring groove in a second direction perpendicular to the second side face.

2. The electrical connector as claimed in claim 1, wherein the second plurality of contacts are lined in turn the first to seventh contacts, the first, the forth and the seventh contacts being used for grounding and the second, the third, the fifth and the sixth being used for delivering signal.

3. An electrical connector providing an interface for storage device, comprising:

an insulated housing having a base portion and an integral tongue portion extending from a front face of the base portion along a first direction, the integral tongue portion defining a first side face parallel to the first direction and a second side face opposite to the first side face;

a plurality of electrical contacts assembled to the insulated housing and lined along the first side face, each of said electrical contacts extending along the first direction for mating with a mating electrical connector;

wherein said integral tongue portion having two ribs extending along the first direction from the front face of the base portion, said two ribs being disposed on the first side face of the integral tongue portion;

wherein the integral tongue portion comprises a power segment for delivering power, a signal segment for delivering signal and a middle segment connecting the power segment and the signal segment, and the power segment and the signal segment could be compatible with an internal micro Serial ATA backplane connector except that the middle segment prevents insertion of the electrical connector into the internal micro Serial ATA backplane connector;

wherein said two ribs divides the plurality of contacts into three groups in turn the first, the second and the third groups, the first group of contacts composing of two optional contacts used for delivering power, the second group of contacts composing of seven contacts used for delivering power, the third group of contacts composing of seven contacts being used for delivering signal;

wherein the electrical connector further comprise a second plurality of electrical contacts assembled to the insulated housing, the second plurality of electrical contacts lined along the second side face, each of said second plurality of electrical contacts extending along the first direction to contact with said mating electrical connector;

wherein the second plurality of electrical contacts composes of seven contacts and are aligned to the first group of contacts and the neighboring rib in a second direction perpendicular to the second side face.

4. The electrical connector as claimed in claim 3, wherein the second plurality of contacts are lined in turn the first to seventh contacts, the first, the forth and the seventh contacts being used for grounding and the second, the third, the fifth and the sixth being used for delivering signal.

5. An electrical connector assembly for connecting a storage device, comprising:

a first electrical connector comprising: a first insulated housing defining an uninterrupted longitudinal slot in a front face, the slot having a first and a second inner side faces facing to each other, and the first and second inner side faces extending in a first direction perpendicular to the front face;

a plurality of electrical contacts disposed in the insulated housing and lined along the first side face, each of said electrical contacts extending along the first direction;

wherein the first inner side face of said slot defining two spaced grooves extending along the first direction from the front face;

a second mating electrical connector comprising: a second insulated housing having a base portion and an uninterrupted longitudinal tongue portion extending from a front face of the base portion along a first direction for mating into the slot of the first insulated housing, the tongue portion defining a first side face parallel to the first direction and a second side face opposite to the first side face;

a plurality of electrical contacts assembled to the insulated housing for mating with the electrical contacts of the first electrical connector, wherein said tongue portion having two spaced ribs extending along the first direction from the front face of the base portion for respectively mating into the grooves the first insulated housing;

wherein the slot and the grooves are shaped compatible with an internal micro Serial ATA plug connector and the grooves prevents insertion of other Serial ATA cables;

wherein the plurality of the contacts are divided into three groups in turn the first, the second and the third groups, the first group of contacts composing of two optional contacts used for delivering power, the second group of contacts composing of seven contacts used for delivering power, the third group of contacts composing of seven contacts being used for delivering signal;

wherein the electrical connector assembly further comprises a second plurality of electrical contacts assembled to the insulated housing and lined along the second side face, each of said second plurality of electrical contacts extending along the first direction for mating with said second electrical connector;

wherein the second plurality of electrical contacts composes of seven contacts and are aligned to the first group of contacts and the neighboring groove in a second direction perpendicular to the second side face.

6. The electrical connector assembly as claimed in claim 5, wherein the second plurality of contacts are in turn the first to seventh contacts, the first, the forth and the seventh contacts being used for grounding and the second, the third, the fifth and the sixth being used for delivering signal.

7. The electrical connector assembly as claimed in claim 5, wherein the tongue portion comprises a power segment for delivering power, a signal segment for delivering signal and a middle segment connecting the power segment and the signal segment, and the power segment and the signal segment could be compatible with an internal micro Serial ATA backplane connector except that the middle segment prevents insertion of the electrical connector into the internal micro Serial ATA backplane connector.

8. The electrical connector assembly as claimed in claim 5, further including a third connector similar to the first connector except the slot is interrupted by a partition, and a fourth connector similar to the second connector except the tongue portion is interrupted by a gap in compliance with the partition so that the third connector can only receive the fourth connector but not the second connector while the first connector can receive the fourth connector also.

* * * * *